United States Patent [19]

Fueglister

[11] 4,433,722

[45] Feb. 28, 1984

[54] HEAT EXCHANGER HAVING PIPE COILS SUPPORTED IN SUPPORT PLATES

[75] Inventor: Alfred Fueglister, CH-8400 Winterthur, Switzerland

[73] Assignee: Sulyer Brothers Limited, Winterthur, Switzerland

[21] Appl. No.: 302,664

[22] Filed: Sep. 15, 1981

[30] Foreign Application Priority Data

Sep. 17, 1980 [CH] Switzerland ..... 6958/80

[51] Int. Cl.[3] ..... F28D 7/00

[52] U.S. Cl. ..... 165/162; 165/163; 122/510

[58] Field of Search ..... 165/162, 163; 122/510

[56] References Cited

U.S. PATENT DOCUMENTS 3,742,567 7/1973 Kaelin ..... 165/162
4,088,184 5/1978 Cavallaro ..... 165/162
4,190,104 2/1980 Frei ..... 165/162
4,296,713 10/1981 Taylor et al. ..... 122/510

*Primary Examiner*—Albert W. Davis, Jr.
*Assistant Examiner*—S. Gayle Dotson
*Attorney, Agent, or Firm*—Kenyon & Kenyon

[57] ABSTRACT

A thin-walled resilient sleeve is disposed between each group of support plates and a pipe at the center of the pipe coils. One end of the sleeve is secured to the central pipe while the other end of the sleeve is secured to the support plates.

The sleeves enable the support plates, which in operation become hotter than the pipe coils, to expand towards the central pipe, with a consequent appreciable reduction in heat expansion of the pipe coils and therefore in bending stressing thereof.

10 Claims, 3 Drawing Figures

HEAT EXCHANGER HAVING PIPE COILS SUPPORTED IN SUPPORT PLATES

This invention relates to a heat exchanger having pipe coils supported in support plates. More particularly, this invention relates to a mounting arrangement for the support plates of a heat exchanger.

Heretofore, it has been known to construct heat exchangers for a heat exchange between a primary medium and a secondary medium of a central pipe, at least one group of support plates secured to and disposed substantially radially of the pipe and pipe coils which are threaded into bores in the support plates. In one such heat exchanger, as described in Swiss Pat. No. 454,931 and U.S. Pat. No. 3,742,567, the support plates have been welded directly to the central pipe to provide a relatively rigid support system for the pipe coils. This known heat exchanger has proved satisfactory in operation in cases where the primary medium flowing through the heat exchanger has been at a moderate temperature. However, when the heat exchanger is used for very high temperatures, for example 800° C., the pipes or tubes flowed through by the secondary medium experience considerable heat expansion effects. This is because, in operation, the uncooled support plates expand radially more than the pipe coils which are cooled by the secondary medium. The pipes of the coils are thus forced outwards at the places where they are supported by the support plates. As a result, the pipes bend further in this zone; the pipes tending to flatten between the support places. Also, differences in axial expansion occur between the support plates and the central pipe.

Accordingly, it is an object of the invention to reduce substantially by simple constructional means the heat expansion differences and the resulting thermal stresses occurring in a heat exchanger of the above kind.

It is another object of the invention to provide a heat exchanger wherein pipe coils are mounted in radially disposed support plates in a manner to allow inward expansion of the support plates.

It is another object of the invention to reduce stresses in the pipe coils of a heat exchanger due to differential heat expansion.

Briefly, the invention provides a heat exchanger which includes a pipe, a plurality of support plates extending radially of the pipe and having a plurality of bores therein, a plurality of pipe coils passing through the bores in the plates and a resilient sleeve disposed about the pipe in spaced relation. One end of this sleeve is secured to the pipe while the opposite end is secured to the support plates.

Because of the presence of the sleeve, the hotter support plates can move resiliently inwards. At the same time, the curvature of a radially central part of the pipes is retained and a radially outer part of the pipes distorts in the same direction, i.e. outwardly, but to a much reduced extent relative to the known heat exchanger. A radially inner part of the pipes can even deform in the opposite direction, with the result that the radius of curvature increases in this region and is reduced in the pipe sections between the support places. These pipe distortions are much less than in the known heat exchanger.

When the support plates move resiliently inwards, the sleeve is pressed radially inwards in the region where the support plates are secured to the sleeve. The sleeve thus bulges out between the securing places. Since the sleeve is thinwalled, these distortions do not result in excessive bending stresses. Also, since the support plates are secured only to one end of the sleeve—i.e., over a short axial length—no appreciable differences in expansion arise axially. Thus, there is no additional stress arising for this reason.

The construction and shape of the various components allow the heat exchanger to be assembled in a simple manner.

Conveniently, to reduce stressing in the sleeves, the sleeves can have a considerable axial length. For example, with the support plates disposed in groups longitudinally of the pipe and with a plurality of sleeves spaced longitudinally of the pipe, each sleeve is secured to the pipe in spaced longitudinal relation to the group of plates to which the sleeve is secured.

Further, in order to prevent the support plates from falling in the event the securement between the sleeve and the support plates ruptures, the pipe is provided with a plurality of projections while the support plates are provided with abutment surfaces for abutting on the projections. These abutment surfaces are spaced from the projectons a distance sufficient to permit heat expansion therebetween during normal operation. In addition, the projections facing the abutment surfaces of one group of support plates may be secured to resilient sleeve which, in turn, is secured to the next adjacent group of support plates.

In the case where the pipe is disposed on a vertical axis, the support plates of an upper group may have lower edges for resting on the upper edges of the next lower group. This allows most of the torques acting on the support plates to be kept away from the sleeves with a consequent considerable reduction in the stressing of the sleeves and of the support plates.

The support plates of adjacent groups may be vertically aligned and provided with a friction-reducing surface on the facing edges to preclude substantial friction forces from being transmitted by way of the radial bearing surfaces of the support plates, something which might otherwise cause excessive stressing.

These and other objects and advantages of the invention will become more apparent from the following detailed description taken in conjunction with the accompanying drawings in which.

Figure 1:
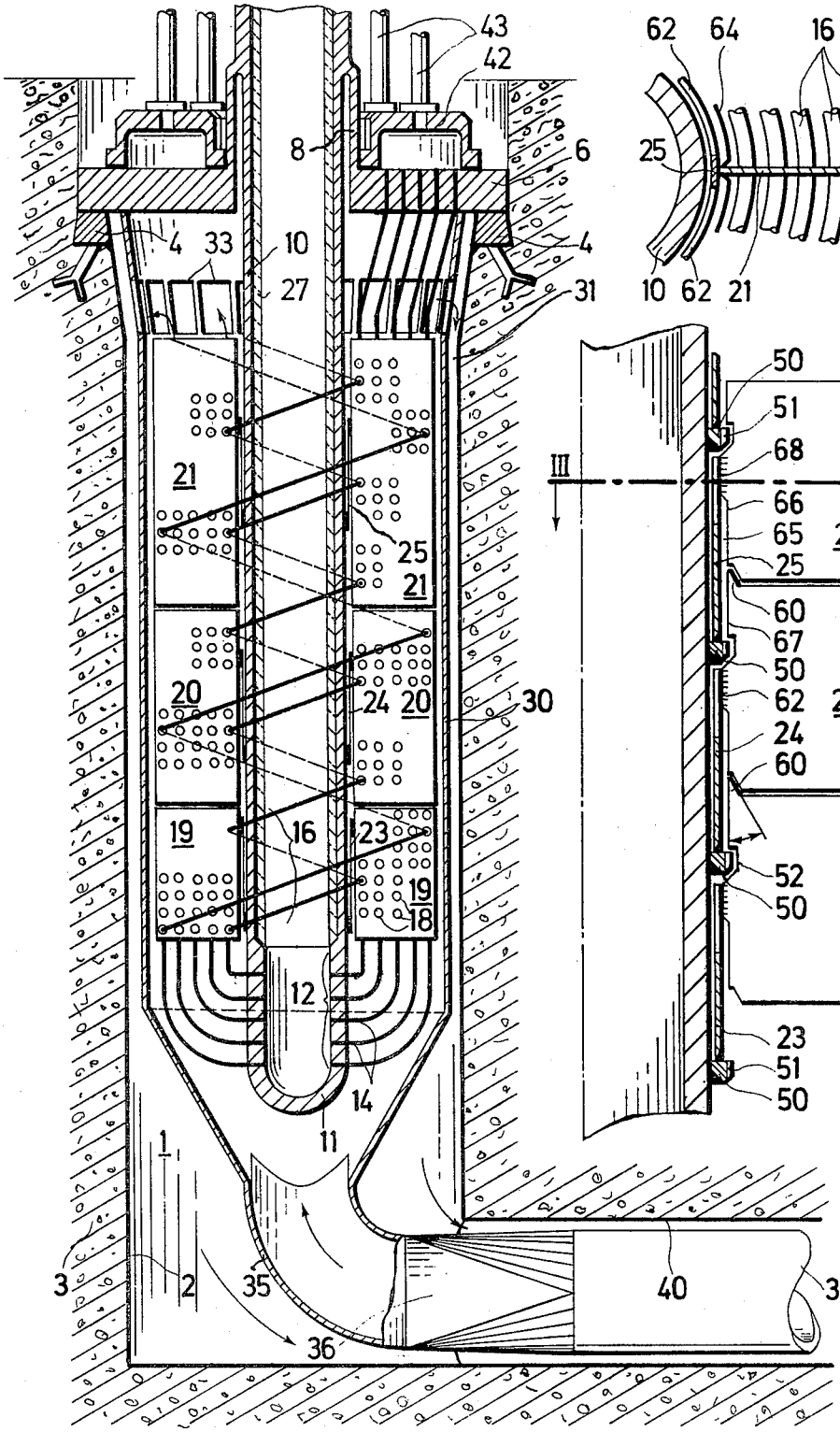
FIG. 1 illustrates an axial section through a heat exchanger in accordance with the invention.

Referring to FIG. 1, the heat exchanger is received in a cylindrical space 1, which has a steel lining 2, in a reactor pressure vessel 3 made of concrete. A support ring 4 is concreted into the top end of the space 1 and is welded sealingly to the lining 2. An annular tube plate 6 rests on the ring 4 and carries an upwardly extending support tube 8 on the inner periphery. A vertical central pipe 10 is secured to the support tube 8 and extends downwardly into the space 1. The wall of the central pipe 10 has a thickened portion 12 near the bottom which subsequently merges into a hemispherical base 11. The bottom ends 14 of heat exchanger pipes are welded in the thickened portion 12 of the pipe 10. The heat exchanger pipes extend arcuately upwards, then merge into pipe coils 16 which extend helically in various cylinders around the central pipe 10. The pipe 10 also has heat insulation 27 on the interior extending upwardly from the thickened portion 12.

The pipe coils 16, only two of which—i.e., an outermost coil 16 and an innermost coil 16 are shown in FIG. 1, are threaded into bores 18 which are likewise not shown in their full number and which are disposed in three longitudinally spaced groups of support plates 19–21, each group comprising four radially extending support plates. The plates are distributed over the periphery of central pipe 10 and increase in height upwardly in line with the varying loadings. Each support plate group is carried by a respective thin-walled resilient sleeve 23–25 which is secured at one end to the plates and rigidly secured, e.g. by welding, near the opposite bottom end to the central pipe 10.

The pipe coils 16 are bent upwardly above the top group of support plates 21 and extend to bores in the tube plate 6 to which they are connected sealingly, preferably by welding. A metal casing 30 extends around the bunch of pipes 16 which extend between the tube plate 6 and base 11 of the central pipe 10. This metal casing 30 narrows conically at the bottom and widens conically at the top. The top end of the casing 30 is secured to the tube plate 6. The bottom end of the conical widening of the casing 30 is formed with a number of windows 33 which are distributed uniformly over the periphery. An elbow 35 of square cross-section is connected to the bottom conical end of the casing 30 and continues as a square-to-circular adapter 36. This adapter 36 is connected to a round section pipe 38 through which primary medium is supplied from a nuclear reactor (not shown). The pipe 38 extends through a passage 40 of the pressure vessel 3, an annular gap being left between the pipe 38 and the passage 40.

An annular and downwardly open distributor 42 is disposed on the tube plate 6, is connected thereto in gas-tight manner and is supplied through a number of pipes 43 with a cold secondary medium.

The heat exchanger shown in FIG. 1 is supplied through the pipe 38 with primary medium—i.e., helium-at a temperature of, for instance, 800° C. This very hot gas flows round the pipe coils 16 which are disposed in the annular space between the central pipe 10 and the casing 30 and is cooled. The gas then flows through the windows 33 into an annular gap 31 between the casing 30 and the lining 2. After flowing through the gap 31 the gas returns to the reactor through the gap between the supply pipe 38 and the passage 40.

The cold secondary medium flows through pipes 43 into the annular distributor 42, then flows through the pipe coils 16, receiving heat therefrom. The heated secondary medium then collects in the bottom part of the central pipe 10, then flows at elevated temperature therethrough to loads (not shown) such as a high-temperature gas turbine and subsequent heat exchangers or to process heating facilities.

When the heat exchanger is assembled, the material used is substantially at ambient temperature. In operation, the pipe coils 16 take up an average temperature somewhere between the temperature of the heat-yielding primary medium and the temperature of the heat-receiving secondary medium. The pipe coils 16 are therefore considerably cooler than the support plates 19–21, the temperature thereof being substantially the temperature of the heat-yielding primary medium. Consequently, in the known heat exchanger, the support plates increase in size relative to the pipes and the pipes are correspondingly distorted outwardly at the support plates, with the result that the radius of pipe curvature decreases near the support plates and increases in the region between support plates. However, as the support plates 19–21 are secured to the sleeves 23–25 resiliently, the support plates, as well as expanding outwardly towards the casing 30, also expand inwardly towards the central pipe 10. The resilient mounting of the support plates 19–21 therefore considerably reduces thermal stressing of the heat exchanger pipes 16.

Figure 2:
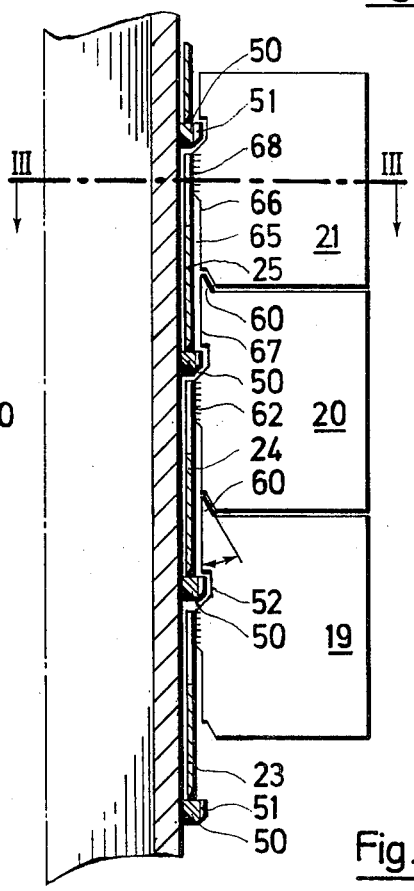
FIG. 2 illustrates an axial sectional view to a larger scale than in FIG. 1, through a part of an alternative form of heat exchanger in accordance with the invention.

Referring to FIG. 2, wherein like reference characters indicate like parts as above, the sleeves 23–25 can be secured by way of rings 50 to the central pipe 10. In addition, the rings 50 have projections 51 which engage with clearance in recesses 52 in the support plates 19–21, so that, in the event of the connection between the sleeves 23–25 and the support plates 19–21 rupturing or separating, the support plates 19–21 remain hanging on the projections 51. This ensures that additional loading of adjacent support plates does not also rupture their support, for such a rupture might cause part or even the whole of a pipe bunch to drop. The recesses 52 for the projections 51 are of a size and shape such that no serious damage can develop between inspections.

Dropping of the support plates due to a rupture can be signalled, for instance, by means of measuring bars (not shown) secured to the support plates.

The support plates 19, 20 have a bevelled projection 60 on the top edge at the radially inner end near the central pipe which co-operates by way of an inclined surface with a matching inclined surface of a recess at the radially inner end on the bottom edge of the support plate 20 or 21 immediately above. This bevelled feature takes up the torque arising from the weight of the support plates and from the weight of the pipes (not shown) on the support plates 19–21, so that the load on the sleeves 23–25 is reduced.

The bevel or inclination angle of the projections 60 can be positive or negative or zero, depending on the relative expansions of the support plates 19–21. The angle is chosen in each individual case to ensure that stresses do not become excessive at critical places, for instance, in the zone where the support plates are secured to the sleeves. Also, the co-operating inclined surfaces can have a friction-reducing covering.

Figure 3:
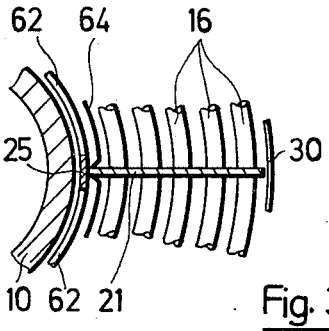
FIG. 3 illustrates a view taken on line III—III of FIG. 2.

To increase the resilience of the sleeves 23–25, they can be formed between the securing places, in the zone where the support plates are secured, with recesses 62, as shown in FIGS. 2 and 3.

Referring to FIG. 3, sleeves 64 can be disposed in the region between two consecutive rings 50 and extend through the gap between, on the one hand, edges 66 and 67 (FIG. 2) of axially adjacent support plates and, on the other hand, that portion of the particular sleeve 23–25 concerned which is opposite the latter edges. The sleeves 64 are each formed with a recess near a zone 68 where the support plate 19–21 is secured to the resilient sleeve 23–25. The sleeves 64 ensure that the primary medium flowing around the pipe coils 16 cannot escape from this flowing pass into the annular gap 65 (FIG. 2) between the innermost tube cylinder and the resilient sleeves 23–25. The sleeves 64 can be offset radially on either side of the support plates 19–21 (FIG. 3).

What is claimed is:

1. A heat exchanger comprising a pipe;

a plurality of support plates extending radially of said pipe and having a plurality of bores therein;

a plurality of pipe coils passing through said bores of said plates, and a thin-walled sleeve disposed about said pipe in spaced relation thereto, one end of said sleeve being secured to said pipe and an opposite end of said sleeve being secured to said support plates to resiliently mount said support plates relative to said pipe.

2. A heat exchanger as set forth in claim 1 comprising a plurality of groups of said plates disposed longitudinally of said pipe, and a plurality of said sleeves, each said sleeve being secured to said pipe in spaced longitudinal relation to a respective group of said plates.

3. A heat exchanger as set forth in claim 1 wherein said pipe has a plurality of projections thereon and said support plates each have abutment surfaces for abutting on said projections in response to said plates separating from said sleeve, said abutment surfaces being spaced from said respective projections a distance sufficient to permit heat expansion therebetween.

4. A heat exchanger as set forth in claim 1 which includes a plurality of resilient sleeves disposed axially of said pipe, groups of said support plates each having an abutment surface and disposed axially of said pipe, a plurality of projections secured to said pipe for receiving said abutment surfaces in response to said plates separating from said sleeves, said projections facing said abutment surfaces of one of said groups of support plates being secured to a resilient sleeve secured to a next adjacent group of support plates.

5. A heat exchanger as set forth in claim 4 wherein said pipe is disposed on a vertical axis and said support plates of an upper group of support plates having lower edges for resting on the upper edges of a next lower group of support plates.

6. A heat exchanger as set forth in claim 5 wherein said support plates of adjacent groups are vertically aligned and have a friction-reducing surface on said edges thereof.

7. A heat exchanger comprising a pipe;

a plurality of longitudinally spaced groups of radially extending support plates disposed about said pipe;

a plurality of pipe coils passing through and supported in said support plates;

a plurality of thin-walled sleeves disposed about said pipe between said pipe and said support plates, each said sleeve being secured at one end to said pipe and at an opposite end to a respective group of plates to resiliently support said group of plates from said pipe.

8. A heat exchanger as set forth in claim 7 which further comprises a plurality of longitudinally spaced rings secured to said pipe, each said ring being secured to a respective said one end of a respective sleeve.

9. A heat exchanger as set forth in claim 1 wherein each ring has a plurality of radial projections thereon and each plate of a respective group of support plates has a recess receiving said projections of a ring secured to a next adjacent upper group of support plates.

10. A heat exchanger as set forth in claim 1 wherein each plate has a bevelled projection on an upper edge at a radially inner end and a recess with an inclined surface on a lower edge at a radially inner end, said bevelled projection of one plate matingly receiving said inclined surface of a recess of a next adjacent upper plate upon a downward deflection of said upper plate.

* * * * *